United States Patent [19]

Szombathelyi

[11] Patent Number: 4,631,890

[45] Date of Patent: Dec. 30, 1986

[54] MODULE ELEMENT, BUILDING CONSTRUCTION AND METHOD FOR ERECTING A BUILDING CONSTRUCTION

[76] Inventor: Imre Szombathelyi, Verecke u. 81, H-1025 Budapest, Hungary

[21] Appl. No.: 770,862

[22] PCT Filed: Nov. 30, 1984

[86] PCT No.: PCT/HU84/00058

§ 371 Date: Sep. 17, 1985

§ 102(e) Date: Sep. 17, 1985

[87] PCT Pub. No.: WO85/02431

PCT Pub. Date: Jun. 6, 1985

[30] Foreign Application Priority Data

Nov. 30, 1983 [HU] Hungary ..... 4107/83

[51] Int. Cl.[4] ..... E04B 1/02

[52] U.S. Cl. ..... 52/570; 52/574

[58] Field of Search ..... 52/424–426, 52/430, 437–442, 220, 221, 281, 279, 250–253, 566–572, 429, 574

[56] References Cited

U.S. PATENT DOCUMENTS

| | | | |
|---|---|---|---|
| 679,746 | 8/1901 | Grueby | 52/430 |
| 1,052,788 | 2/1913 | Bates | 52/220 |
| 1,535,030 | 4/1925 | Nelson | 52/250 |
| 1,585,374 | 5/1926 | Carlsson | 52/569 |
| 1,770,082 | 7/1930 | McPherson | 52/570 |
| 2,038,615 | 4/1936 | Underdown | 52/281 |
| 2,205,589 | 7/1940 | Leemhuis | 52/279 |
| 2,260,178 | 10/1941 | Guignon | 52/221 |
| 2,412,253 | 12/1946 | Diggs | 52/426 |

FOREIGN PATENT DOCUMENTS

| | | | |
|---|---|---|---|
| 167489 | 1/1951 | Austria | 52/429 |
| 1124806 | 7/1956 | France | 52/570 |
| 565182 | 7/1957 | Italy | 52/570 |

*Primary Examiner*—James L. Ridgill, Jr.
*Attorney, Agent, or Firm*—Young & Thompson

[57] ABSTRACT

Building construction formed of structural module elements formed as a rectangular plate and having on the plate a coupling (2) for interconnecting them. The module element has a U-like cross section with two legs (3, 4) and a rib (5) between them, one leg (3) is longer and narrower than the other leg (4) and is connected to the plate surface, and the distance between the legs (3, 4) at the rib (5) is no greater than the least width of the other leg (4). The module elements are parallelly connected to each other by interconnecting the coupling (2) of one module element with the coupling (2) of the adjacent one, whereupon the upwardly or downwardly extending thicker legs (4) of one element are disposed between the downwardly or upwardly extending legs (3, 4) of the other elements.

5 Claims, 3 Drawing Figures

MODULE ELEMENT, BUILDING CONSTRUCTION AND METHOD FOR ERECTING A BUILDING CONSTRUCTION

FIELD OF THE INVENTION

The invention relates to a structural module element for building constructions or for constructional toys. Furthermore, the invention relates to a building construction formed of module elements as well as to a method for erecting reinforced ferroconcrete building constructions from module elements.

PRIOR ART

Prefabricated building elements, especially precast concrete elements are widely used in to-days building technology. However, the use of structural module elements e.g. for the cradling of concrete buildings is a major challenge nowadays. The problems of easy connecting, variability, adequate firmnes and stability, easy removing after casting of the concrete among others are still unsolved.

ESSENCE OF THE INVENTION

The main object of the invention is to provide a structural module element, which is interconnectable for forming a building structure in an easy and simple manner and, eventually, which is removable after the solidification of the concrete casting.

Further object of the invention is to provide a building construction, for the erection of which the structural module elements can be used either as constructional parts or as cradling which can be removed after the solidification of the concrete if desired.

Still another object of the invention is to provide a method for erecting reinforced ferroconcrete building constructions without special supporting framework of the cradle.

According to the improvement in the present invention, the coupling means of the structural module element has a U-like cross section with two legs and an interconnecting rib between the legs, the one leg of which is longer and narrower than the other leg and is connected to the plate surface, the other leg is shorter and thicker than the first leg, and the distance between the legs at the rib is equal to or shorter than the smallest width of the second leg. This form of the module element provides for comparatively easy and simple interconnection of the elements without the need of extra supporting framework.

In a preferred embodiment, the second leg of said coupling means has a changing cross section and it is thicker at the rib than at its top surface for which it has an inclined inner surface facing the first leg.

In another embodiment, an inner surface of the first leg is co-planar to the plate surface for which the first leg is sinked into the base plate. The coupling means and the module elements can be made of one piece.

According to the invention, it is preferred, too, when more than one coupling means are arranged on the plate surface in an equidistantial manner in a first direction as well as in a second direction being perpendicular to said first direction.

In further aspects, the improvement in this invention covers a new building construction, too, wherein more than one coupling means are provided on the base plate in an equidistantial manner in a first direction as well as in a second direction being perpendicular to said first direction, and each of the coupling means has a U-like cross section with two legs and an interconnecting rib between the legs, and the first leg is longer and narrower than the second leg and is connected to the plate surface of the module element, and the second leg is shorter and thicker than the first leg, and the distance between the legs at the rib is equal to or shorter than the smallest width of the second leg, and the module elements are parallelly connected to each other by interconnecting the coupling means of one module element with the coupling means of the adjacent module element, whereupon the second legs of the module element take place between the first and second legs of the adjacent module element.

Preferably, the second legs of the coupling means have a changing cross section and they are thicker at the ribs than at their top surfaces for which the second legs each has an inclined inner surface facing the first legs, and the distance between the first and second legs of the coupling means are equal to or smaller than the smallest width of the second legs at their top surface, and the inner surfaces of the second legs of the coupling means of one module element are laid on the inner surfaces of the second legs of the adjacent module element and the outer surfaces of the second legs of the first module elements are pressed against the inner surfaces of the first legs of the adjacent module element. With this, vertical channels and horizontal channels can be formed between the coupling means of the adjacent module elements interconnected by the coupling means. These channels can be filled with concrete.

The method in this invention is improved for comprising the steps of erecting a spatial, rigid, self-sustaining iron framework carrying the module elements on both sides of the framework, interconnecting the module elements at their coupling means, forming channels between the coupling means in the course of the interconnection, arranging the framework within the channels of the module elements and filling out the channels with concrete. Pipes and other conduits can be fixed on the framework before filling the channels with concrete.

BRIEF DESCRIPTION OF THE DRAWINGS

Further objects and details of the present invention will not be described with reference to the accompanying drawings, in which.

PREFERRED EMBODIMENT

Figure 1:
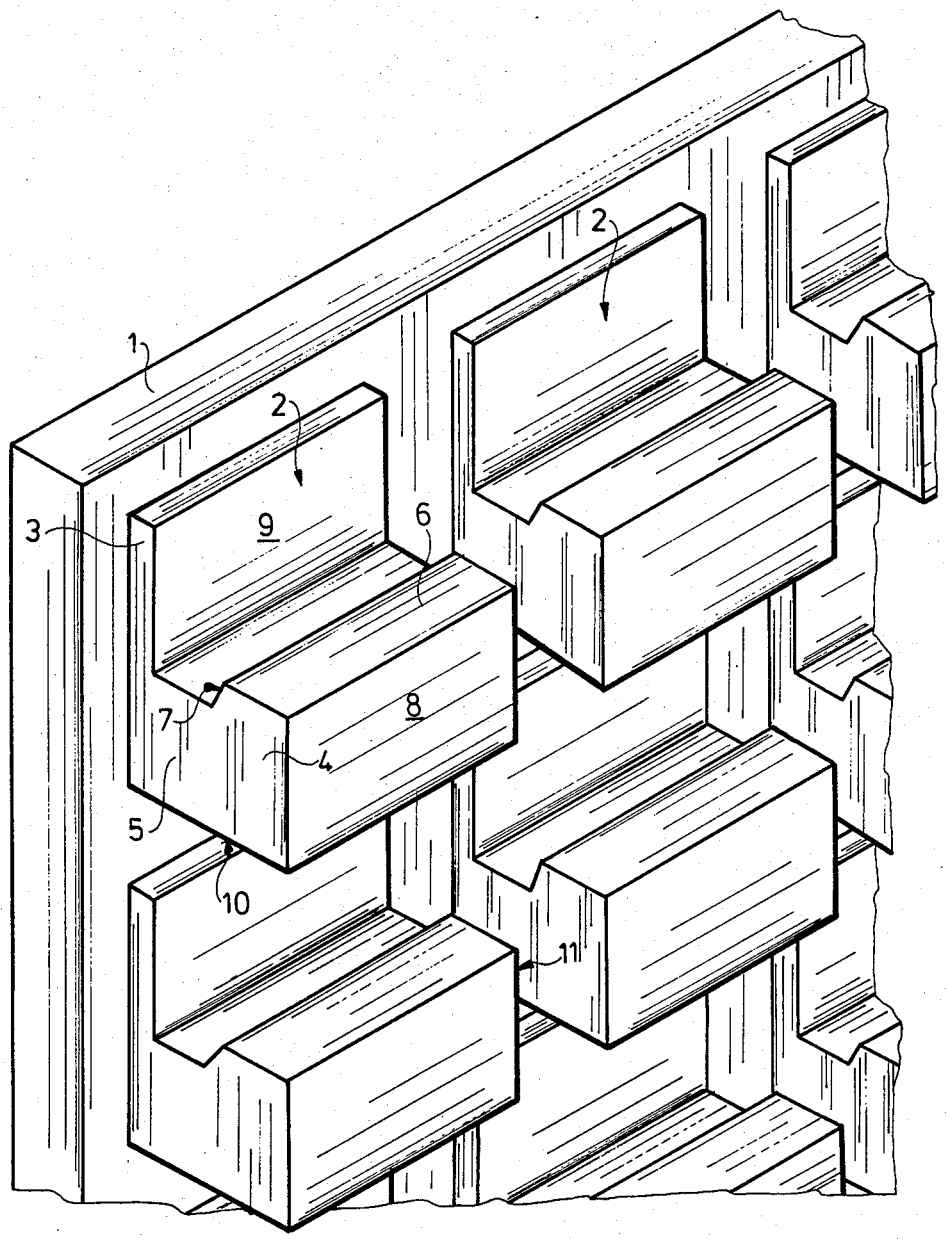
FIG. 1 is a portion of a perspective view of an embodiment of the module element in this invention, FIG 2. shows a cross section of two interconnected module elements.

As it can clearly be seen in FIG. 1, this embodiment of the structural module element in this invention has a base plate 1 on the inner surface of which coupling means 2 are arranged. In this invention, the coupling means 2 have a U-like cross section (see FIG. 2, too) with two legs 3 and 4 and an interconnecting rib 5 between the legs 3 and 4. One leg 3 is longer and narrower than the other leg 4 and, thus, leg 4 is shorter and thicker than leg 3. Furthermore, the distance between legs 3 and 4 measured at rib 5 is not greater than the smallest width of leg 4. In the embodiment shown in FIGS. 1 and 2, this smallest width of leg 4 can be measured on the top surface 6 of leg 4 since this leg 4 has a changing cross section being thicker at rib 5 than at the top surface 6. For this, leg 4 has an inclined inner surface 7 facing leg 3. An outer surface 8 of leg 4 is parallel to leg 3.

In the embodiment illustrated in the drawings, leg 3 of coupling means 2 is connected to the inner surface of base plate 1 and, thus, leg 3 forms a surface abuting from the inner surface of plate 1. However, in other embodiments, leg 3 can be sinked into the inner surface of base plate 1. In this case, the inner surface of leg 3 will be co-planar with the inner surface of plate 1.

Coupling means 2 are arranged on base plate 1 in an equidistantial manner in a longitudinal direction as well as in a transverse direction being perpendicular to the longitudinal direction. Thus, coupling means 2 are in alignement in both directions and spaces with constant measurements remains free between them. These spaces are shown as channels at 10 and 11.

Figure 2:
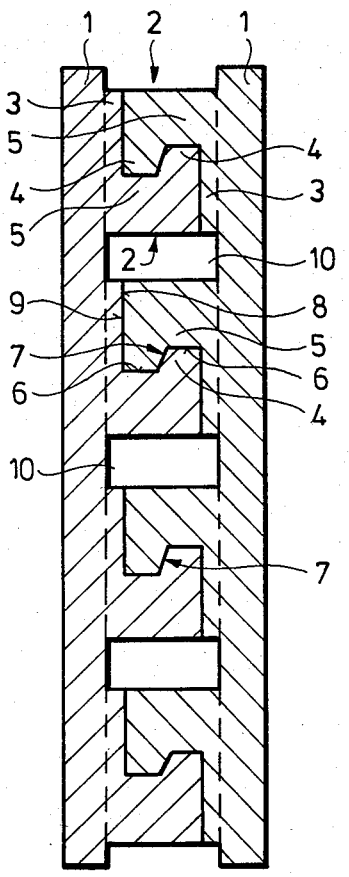

In FIG. 2, two base plates 1 interconnected by coupling means 2 are shown. For this, base plate 1 on the right side of the figure is turned upside down and leg 4 of each coupling means 2 occupies the space between leg 3 and leg 4 of another coupling means 2. During this, inclined inner surfaces 7 of adjacent legs 4 touches each other, e.g. surface 7 of coupling means 2 of base plate 1 on the right side slides down on surface 7 of coupling means 2 of base plate 1 on the left side. As a result of this, base plate 1 on the right side will forcingly move in the direction of base plate 1 on the left side, the outer surface 8 of legs 4 will be pressed against inner surfaces 9 of legs 3. In the position shown in FIG. 2, top surface 6 of leg 4 is just as big as the distance between legs 3 and 4. If top surface 6 were smaller than the distance between legs 3 and 4, top surface 6 would not touch rib 5 between legs 3 and 4.

Channels 10 in the longitudinal direction left free between coupling means 2 are clearly apparent from FIG. 2.

Figure 3:
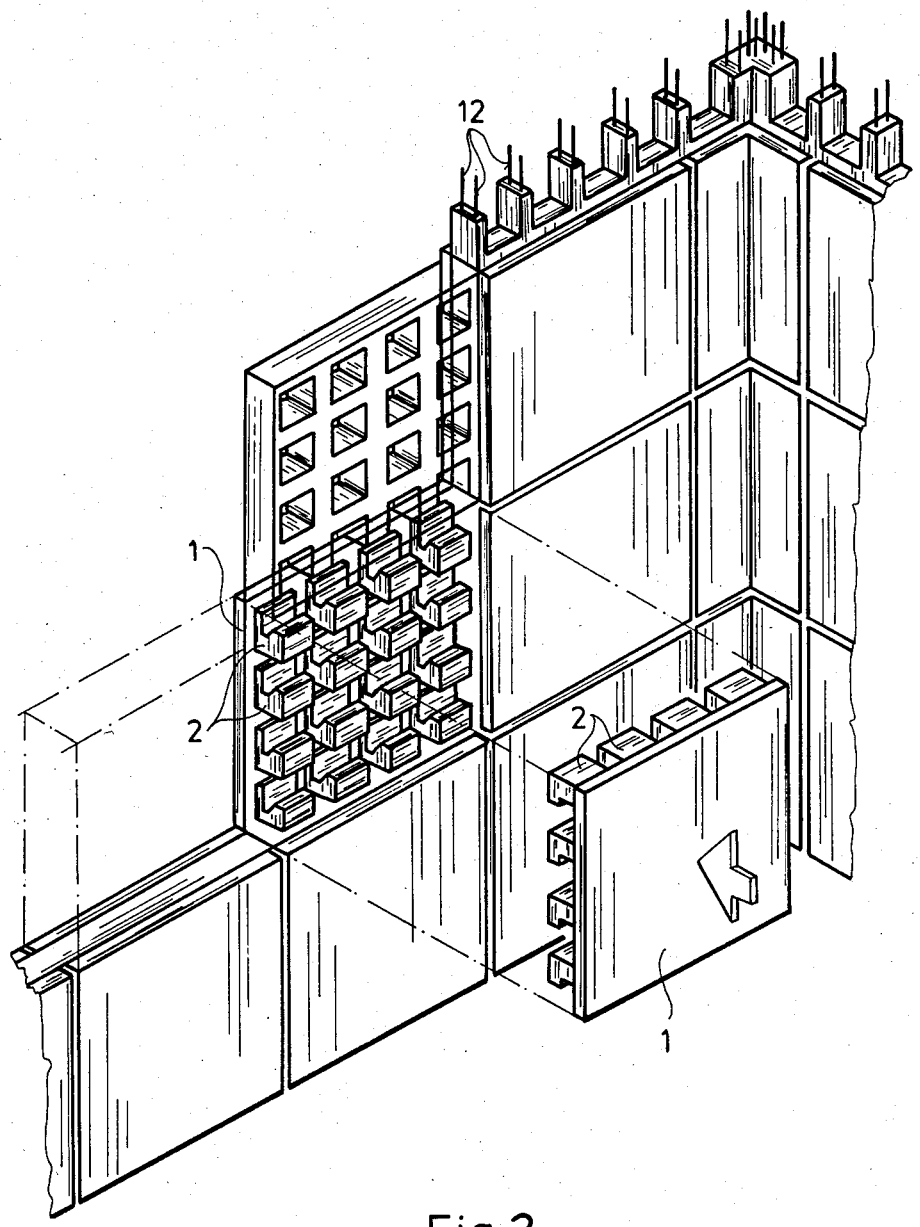
FIG. 3 illustrates a portion of the perspective view of a building construction according to this invention during erection.

In FIG. 3, the building construction assambled from the module elements as shown in FIGS. 1 and 2 is illustrated.

For erecting a building according to this invention, an iron framework 12 is welded together from iron rods as it is usual with ferroconcrete building constructions. This framework 12 will be the reinforcement structure of the building. But in this stage, it serves as a holding structure for the module elements. Of course, the rods of framework 12 are arranged for occupying would-be channels 10 and 11 between coupling means 2 of the module elements. After coupling together the module elements from both sides of framework 12 at coupling means 2 as previously described, the channels 10 and 11 is filled out with concrete. For the sake of better illustration, framework 9 is removed at the left hand portion of FIG. 3 and the module elements are removed after solidification of the concrete at the right hand portion.

Before filling out the channels 10 and 11 with concrete, other installational parts of the building such as electrical and electronic conduits, water and gas pipes, spouts etc. can be fixed on framework 12. Furthermore, ventillation channels for heating and/or cooling can be provided in channels 10, 11.

I claim:

1. Building construction formed of module elements having a rectangular base plate on at least one side of which a plurality of coupling means is arranged in an equidistant manner in a horizontal as well as in a vertical direction, and each of the coupling means (2) having a U-shaped cross section with two legs (3, 4) and an interconnecting rib (5) between the legs (3, 4), and the first leg (3) being longer and narrower than the second leg (4) and is connected to the plate surface of the module element, and the second leg (4) being shorter and thicker than the first leg (3), and the distance between the legs (3, 4) at the rib (5) no greater than the least width of the second leg (4), the module elements being parallelly connected to each other by interconnecting the coupling means (2) of one module element with upwardly direction said second legs (4) with the coupling means (2) of the adjacent module element with downwardly directed said second legs, whereupon the second legs (4) of the one module element are disposed between the first and second legs (3, 4) of the adjacent module element.

2. Building construction as claimed in claim 1, wherein the second legs (4) of the coupling means (2) have a changing cross section and they are thicker at the ribs (5) than at their top surfaces (6) for which the second legs (4) each has an inclined inner surface facing the legs (3), and the distance between the first and second legs (3, 4) of the coupling means (2) no greater than the least width of the second legs (4) at their top surface (6), and the inner surfaces (7) of the second legs (4) of the coupling means (2) of one module element are laid on the inner surfaces (7) of the second legs (4) of the adjacent module element and the outer surfaces (8) of the second legs (4) of the first module elements are pressed against the inner surfaces (9) of the first legs (3) of the adjacent module element.

3. Building construction as claimed in claim 1, wherein vertical channels (10) and horizontal channels (11) are formed between coupling means (2) interconnecting the adjacent module elements.

4. Building construction as claimed in claim 3, wherein structural parts are arranged within said channels (10, 11).

5. Building construction as claimed in claim 3, wherein the channels (10, 11) are filled out with concrete.

* * * * *